US010954826B2

(12) United States Patent
Buonocore et al.

(10) Patent No.: US 10,954,826 B2
(45) Date of Patent: Mar. 23, 2021

(54) ACTUATION APPARATUS

(71) Applicant: EATON INTELLIGENT POWER LIMITED, Dublin (IE)

(72) Inventors: Gennaro Buonocore, Turin (IT); Michele Angelo Cecchi, Turin (IT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/079,107

(22) PCT Filed: Feb. 24, 2017

(86) PCT No.: PCT/EP2017/054419

§ 371 (c)(1),
(2) Date: Aug. 23, 2018

(87) PCT Pub. No.: WO2017/144706

PCT Pub. Date: Aug. 31, 2017

(65) Prior Publication Data

US 2019/0063268 A1 Feb. 28, 2019

(30) Foreign Application Priority Data

Feb. 26, 2016 (GB) ..... 1603344

(51) Int. Cl.
*F01L 1/18* (2006.01)
*F01L 13/00* (2006.01)

(52) U.S. Cl.
CPC ..... *F01L 1/185* (2013.01); *F01L 13/0005* (2013.01); *F01L 2001/186* (2013.01); *F01L 2013/001* (2013.01)

(58) Field of Classification Search
CPC . F01L 1/185; F01L 13/0005; F01L 2013/001; F01L 2001/186; F01L 2820/031; F01L 2105/00

(Continued)

(56) References Cited

U.S. PATENT DOCUMENTS 4,151,817 A 5/1979 Mueller
5,524,580 A * 6/1996 Muir ..... F01L 1/185 123/90.16

(Continued)

FOREIGN PATENT DOCUMENTS

DE 2753197 A1 * 6/1978 ..... F01L 1/185
DE 2753197 A1 6/1978

(Continued)

*Primary Examiner* — Patrick Hamo
*Assistant Examiner* — Wesley G Harris
(74) *Attorney, Agent, or Firm* — Leydig, Voit & Mayer, Ltd.

(57) ABSTRACT

An actuation apparatus for actuating a switchable valve train component of an internal combustion engine includes: a lever for contacting an actuation source and contacting the switchable valve train component; and a biasing unit. The biasing unit contacts the lever. In use, the biasing unit becomes biased by the lever when the actuation source moves the lever when the actuation source attempts to actuate the switchable valve train component, via the lever, when the switchable valve train component is in an un-activatable state. The biasing unit causes the lever to activate the switchable valve train component when the switchable valve train component is in an activatable state again.

20 Claims, 10 Drawing Sheets

(58) Field of Classification Search
USPC ..... 123/198 F, 90.16, 90.41
See application file for complete search history.

(56) References Cited

U.S. PATENT DOCUMENTS

| | | | | | |
|---|---|---|---|---|---|
| 5,584,267 | A * | 12/1996 | Muir | F01L 1/185 | 123/198 F |
| 5,619,958 | A | 4/1997 | Hampton et al. | | |
| 5,653,198 | A | 8/1997 | Diggs | | |
| 5,682,848 | A | 11/1997 | Hampton et al. | | |
| 5,690,066 | A * | 11/1997 | Hampton | F01L 1/185 | 123/198 F |
| 6,805,083 | B2 * | 10/2004 | Kaczmarek | F01L 1/185 | 123/195 C |
| 6,971,349 | B2 * | 12/2005 | Burch | F01L 13/0015 | 123/90.16 |
| 7,621,242 | B2 * | 11/2009 | Kitagawa | F01L 13/0021 | 123/90.16 |
| 9,470,116 | B2 | 10/2016 | Cecur | | |
| 2003/0154941 | A1 * | 8/2003 | Hendriksma | F01L 1/18 | 123/90.16 |
| 2010/0059015 | A1 * | 3/2010 | Surnilla | F01L 1/143 | 123/295 |
| 2015/0128890 | A1 * | 5/2015 | Cecur | F01L 1/18 | 123/90.16 |
| 2018/0363518 | A1 * | 12/2018 | Raimondi | F01L 1/047 | |

FOREIGN PATENT DOCUMENTS

| | | | |
|---|---|---|---|
| DE | 19700316 | A1 | 7/1997 |
| EP | 0767296 | A1 | 4/1997 |
| EP | 2653673 | A1 | 10/2013 |

* cited by examiner

ACTUATION APPARATUS

CROSS-REFERENCE TO PRIOR APPLICATIONS

This application is a U.S. National Phase application under 35 U.S.C. § 371 of International Application No. PCT/EP2017/054419, filed on Feb. 24, 2017, and claims benefit to British Patent Application No. GB 1603344.1, filed on Feb. 26, 2016. The International Application was published in English on Aug. 31, 2017 as WO 2017/144706 under PCT Article 21(2).

FIELD

The present invention relates to actuation, and more specifically actuation of switchable engine or valve train components in an internal combustion engine.

BACKGROUND

Internal combustion engines may comprise switchable engine or valve train components. For example, valve train assemblies may comprise a switchable rocker arm to provide for control of valve actuation by alternating between at least two or more modes of operation (e.g. valve-lift modes). Such rocker arms typically involve multiple bodies, such as an inner arm and an outer arm. These bodies are latched together to provide one mode of operation (e.g. a first valve-lift mode) and are unlatched, and hence can pivot with respect to each other, to provide a second mode of operation (e.g. a second valve-lift mode). Typically, a moveable latch pin is used and actuated and de-actuated to switch between the two modes of operation.

The transmission of an actuation force to a switchable valve train or engine component such as a switchable rocker arm can be difficult due to packaging constraints and functional requirements. Also, in some cases, actuation may not be possible immediately due to an engine condition.

It is desirable to provide an actuation transmission system that addresses these problems.

SUMMARY

In an embodiment, the present invention provides an actuation apparatus for actuating a switchable valve train component of an internal combustion engine, the apparatus comprising: a lever configured to contact an actuation source and to contact the switchable valve train component; and a biasing unit; wherein the biasing unit contacts the lever, wherein, in use, the biasing unit is configured to become biased by the lever when the actuation source moves the lever when the actuation source attempts to actuate the switchable valve train component, via the lever, when the switchable valve train component is in an un-activatable state, whereby the biasing unit causes the lever to activate the switchable valve train component when the switchable valve train component is in an activatable state again.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
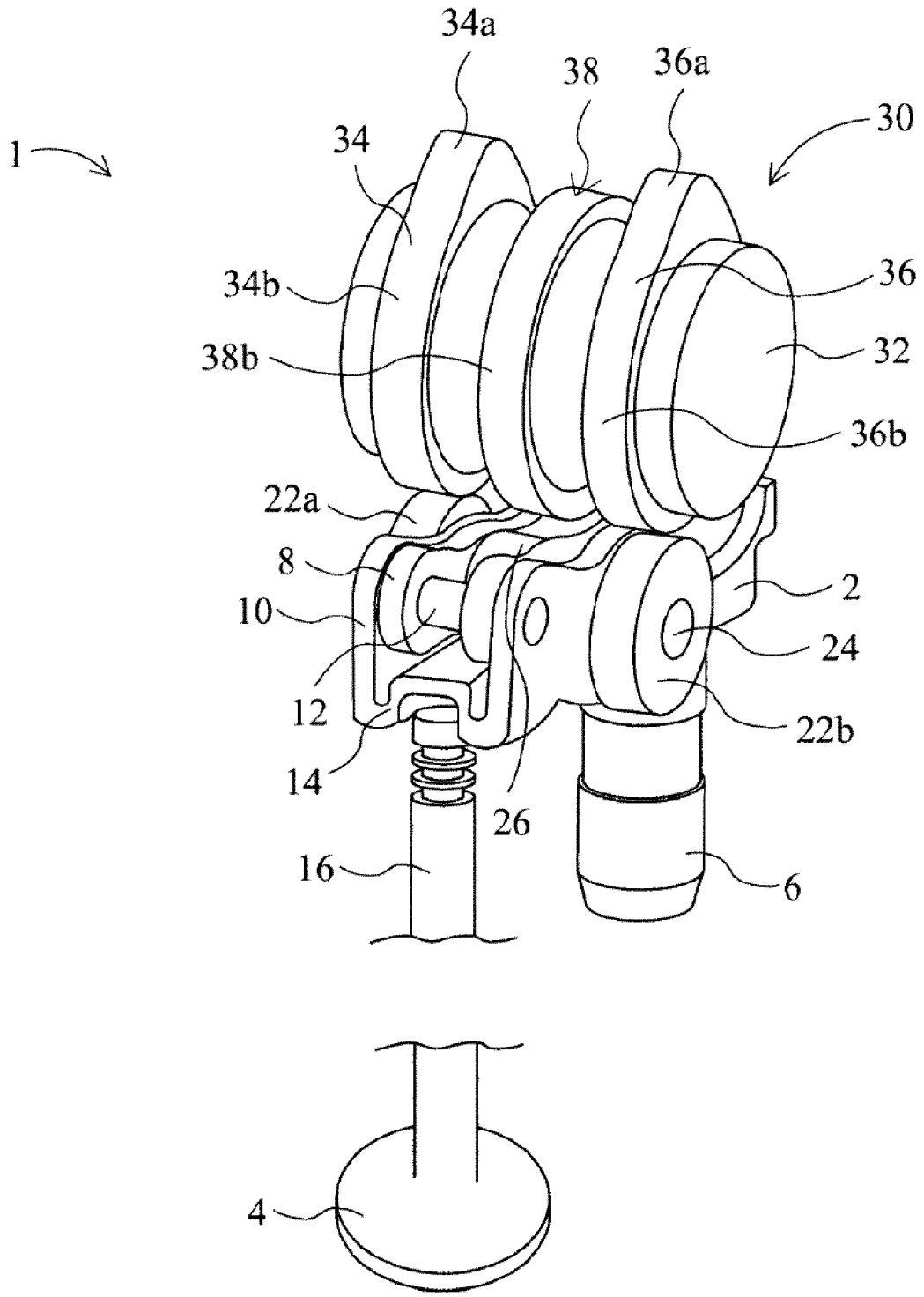
FIG. 1 illustrates a schematic perspective view of a valve train assembly including a rocker arm, according to an example.
Figure 2:
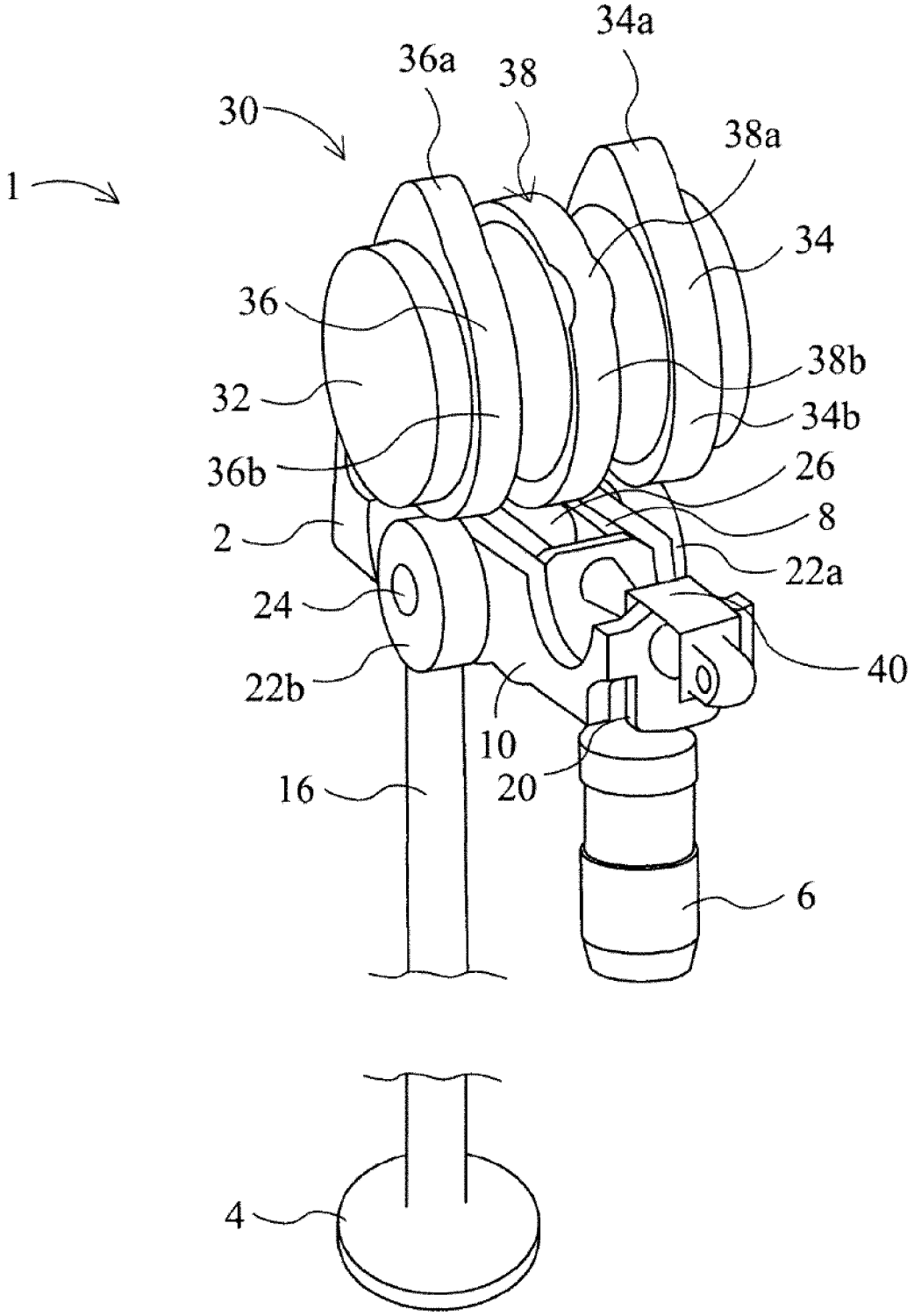
FIG. 2 illustrates another perspective view of the valve train assembly, according to an example.

FIGS. 1 and 2 illustrate schematically a valve train assembly 1 comprising a rocker arm 2 according to an example. Although the example rocker arm 2 is referred to in the below, it will be appreciated that the rocker arm 2 may be any rocker arm comprising a plurality of bodies that move relative to one another, and which are latched together to provide one mode of operation (e.g. a latched valve-lift mode) and are unlatched, and hence can move with respect to each other, to provide a second mode of operation (e.g. an unlatched valve-lift mode).

Referring again to the example of FIGS. 1 and 2, a valve train assembly 1 comprises a rocker arm 2, an engine valve 4 for an internal combustion engine cylinder and a lash adjustor 6. The rocker arm 2 comprises an inner body or arm 8 and an outer body or arm 10. The inner body 8 is pivotally mounted on a shaft 12 which serves to link the inner body 8 and outer body 10 together. A first end 14 of the outer body 10 engages the stem 16 of the valve 4 and at a second end 20 the outer body 10 is mounted for pivotal movement on the lash adjustor 6 which is supported in an engine block. The lash adjuster 6, which may for example be a hydraulic lash adjuster, is used to accommodate slack between components in the valve train assembly 1. Lash adjusters are well known per se and so the lash adjuster 6 will not be described in detail.

The rocker arm 2 is provided with a pair of main lift rollers 22*a* and 22*b* rotatably mounted on an axle 24 carried by the outer body 10. One of the main lift rollers 22*a* is located one side of the outer body 10 and the other of the main lift rollers 22*b* is located the other side of the outer body 10. The rocker arm 2 is further provided with a secondary lift roller 26, located within the inner body 8 and rotatably mounted on an axle (not visible in FIGS. 1 and 2) carried by the inner body 8.

A three lobed camshaft 30 comprises a rotatable camshaft 32 mounted on which are first 34 and second 36 main lift cams and a secondary lift cam 38. The secondary lift cam 38 is positioned between the two main lift cams 34 and 36. The first main lift cam 34 is for engaging the first main lift roller 22*a*, the second main lift cam 36 is for engaging the second main lift roller 22*b* and the secondary lift cam 38 is for engaging the secondary lift roller 26. The first main lift cam 34 comprises a lift profile (i.e. a lobe) 34*a* and a base circle 34*b*, second main lift cam 36 comprises a lift profile 36*a* and a base circle 36*b* and the secondary lift cam 38 comprises a lift profile 38*a* and a base circle 38*b*. The lift profiles 34*a* and 36*a* are substantially of the same dimensions as each other and are angularly aligned. The lift profile 38*a* is smaller than the lift profiles 34*a* (both in terms of the height of its peak and in terms of the length of its base) and is angularly offset from them.

The rocker arm 2 is switchable between a dual lift mode which provides two operations of the valve 4 (a valve operation is an opening and corresponding closing of the valve) per engine cycle (e.g. full rotation of the cam shaft 32) and a single lift mode which provides a single operation of the valve 4 per engine cycle. In the dual lift mode, the inner body 8 and the outer body 10 are latched together by a latching arrangement 40 (see FIG. 2) and hence act as a single solid body. With this particular arrangement, the dual lift mode provides a higher main valve lift and a smaller secondary valve lift per engine cycle. The single lift mode provides just the main valve lift per engine cycle. The single lift mode is an example of a first valve-lift mode, and the dual lift mode is an example of a second valve-lift mode of the valve train assembly 1.

During engine operation in the dual lift mode, as the cam shaft 32 rotates, the first main lift cam's lift profile 34*a* engages the first main lift roller 22*a* whilst, simultaneously, the second main lift cam's lift profile 36*a* engages the second main lift roller 22*b* and together they exert a force that causes the outer body 10 to pivot about the lash adjuster 6 to lift the valve stem 16 (i.e. move it downwards in the sense of the page) against the force of a valve spring thus opening the valve 4. As the peaks of the lift profiles 34*a* and 36*a* respectively pass out of engagement with the first main lift roller 22*a* and the second main lift roller 22*b*, the valve spring begins to close the valve 4 (i.e. the valve stem 16 is moved upwards in the sense of the page). When the first main lift cam's base circle 34*b* again engages the first main lift roller 22*a* and the second main lift cam's 36 lift profile engages the second main lift roller 22*b* the valve is fully closed and the main valve lift event is complete.

As the camshaft 32 continues to rotate, then, the secondary lift cam's lift profile 38*a* engages the secondary lift roller 26 exerting a force on the inner body 8 which force, as the inner body 8 and the outer body 10 are latched together, is transmitted to the outer body 10 causing the outer body 10 to pivot about the lash adjuster 6 to lift the valve stem 16 against the force of a valve spring thus opening the valve 4 a second time during the engine cycle. As the peak of the lift profile 38*a* passes out of engagement with the secondary lift roller 26 the valve spring begins to close the valve 4 again. When the secondary lift cam's base circle 38*b* again engages the secondary lift roller 26 the valve 4 is fully closed and the second valve lift event for the current engine cycle is complete.

The lift profile 38*a* is shallower and narrower than are the lift profiles 34*a* and 36*a* and so consequently the second valve lift event is lower and of a shorter duration than is the first valve lift event.

In the single lift mode the inner body 8 and the outer body 10 are not latched together by the latching arrangement 40 and hence in this mode, the inner body 8 is free to pivot with respect to the outer body 10 about the shaft 12. During engine operation in the single lift mode, as the cam shaft 32 rotates, when the first main lift cam's lift profile 34*a* engages the first main lift roller 22*a* and the second main lift cam's lift profile 36*a* engages the second main lift roller 22*b*, the outer body 10 pivots about the lash adjuster 6 and, in an identical way as in the dual lift mode, a main valve lift event occurs. As the camshaft 32 continues to rotate, then, the secondary lift cam's lift profile 38*a* engages the secondary lift roller 26 exerting a force on the inner body 8. In the single lift mode, however, as the inner body 8 and the outer body 10 are not latched together, this force is not transmitted to the outer body 10 which hence does not pivot about the lash adjuster 6 and so there is no additional valve event during the engine cycle. Instead, as the secondary lift cam's lift profile 38*a* engages the secondary lift roller 26, the inner body 8 pivots with respect to the outer body 10 about the shaft 12 accommodating the motion that otherwise would be transferred to the outer body 10. A torsional lost motion spring (not shown in FIGS. 1 and 2) is provided to return the inner body 8 to its starting position relative to the outer body 10, once the peak of the lift profile 38*a* has passed out of engagement with the secondary lift roller 26.

In one embodiment, this arrangement may be used to provide switchable Internal Exhaust Gas Recirculation (IEGR) control. For example, if the valve 4 is an exhaust valve for an engine cylinder, the main valve lift acts as the main exhaust lift of an engine cycle, and the timing of the secondary valve lift may be arranged so that it occurs when an intake valve for that cylinder, controlled by a further rocker arm mounted pivotally on a further lash adjuster and which pivots in response to an intake cam mounted on the cam shaft 32, is open. The simultaneous opening of the intake and exhaust valves in this way ensures that a certain amount of exhaust gas remains in the cylinder during combustion which, as is well known, reduces NOx emissions. Switching to the single lift mode deactivates the IEGR function, which deactivation may be desirable under certain engine operating conditions. As will be appreciated by those skilled in the art, this switchable IEGR control may also be provided if the valve 4 is an intake valve with the timing of the secondary valve lift arranged to occur when an exhaust valve for that cylinder is open during the exhaust part of an engine cycle.

Figure 3:
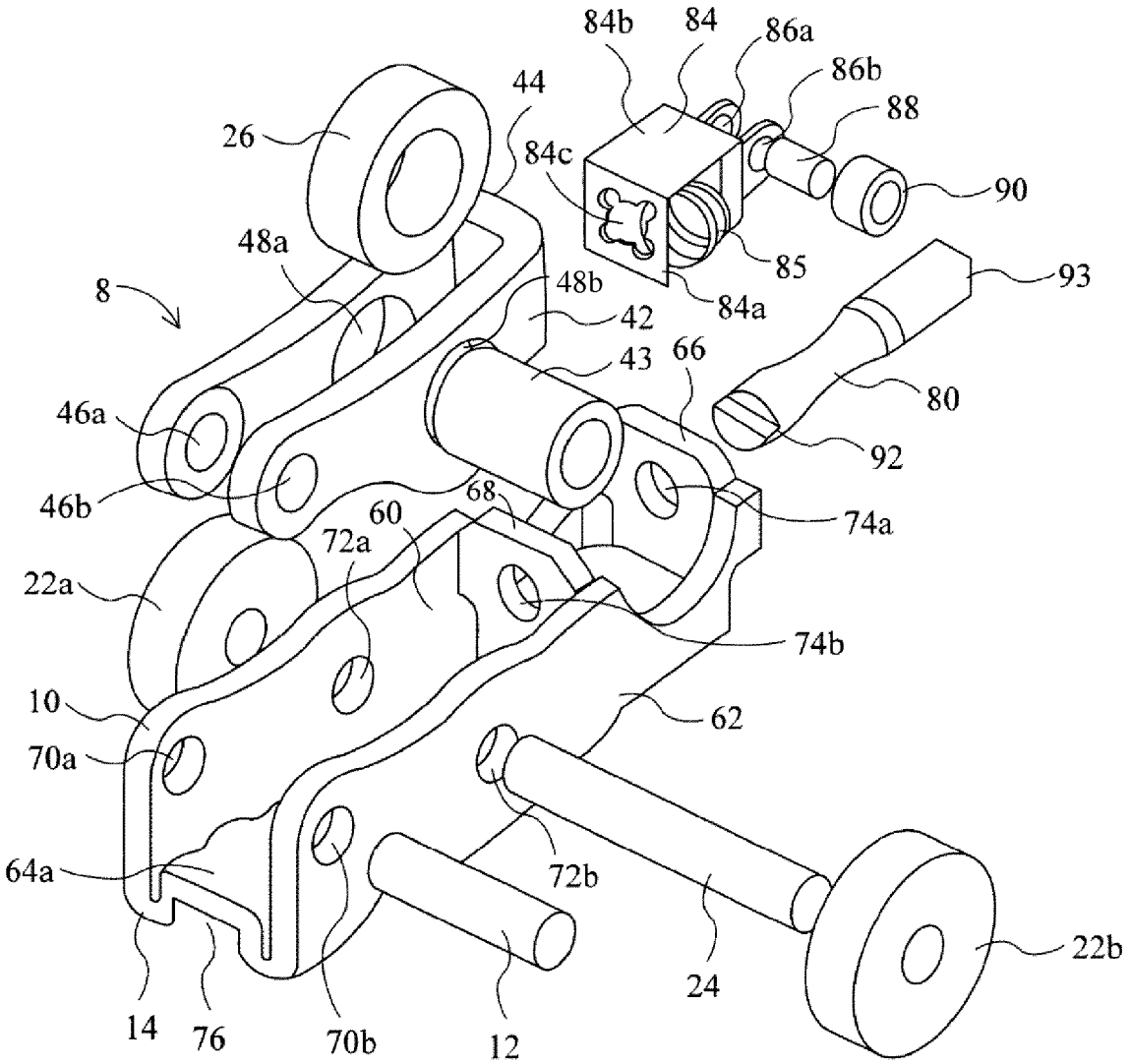
FIG. 3 is an exploded view of the rocker arm, according to an example.

As is best understood from FIG. 3, the secondary lift roller 26 is mounted on a hollow inner bushing/axle 43 which is supported in the apertures 48*a* and 48*b*. The axle 24 extends through the inner bushing/axle 43 (and hence through the inner roller 26) and the diameter of the axle 24 is somewhat smaller than the inner diameter of the inner bushing/axle 43 to allow movement of the assembly of the inner body 8, axle 43 and inner roller 26 relative to the outer body 10. The main lift rollers 22*a* and 22*b* are therefore arranged along a common longitudinal axis and the secondary lift roller 26 is arranged along a longitudinal axis that is slightly offset from this. This arrangement of axles and rollers ensures that the rocker 2 arm is compact and facilitates manufacturing the inner 8 and outer 10 bodies from stamped metal sheets.

As is also best seen from FIG. 3, the latching arrangement 40 comprises the latch pin 80 and an actuation member 84.

The actuation member 84 comprises a sheet bent along its width to form first 84*a* and second 84*b* rectangular portions which define a right angle. The first portion 84*a* defines a hole 84*c*. The actuation member 84 further comprises a pair of winged portions extending rearwardly from the second portion 84*c* each of which defines a respective one of a pair of apertures 86*a*, 86*b* for supporting a shaft 88 on which is mounted a roller 90. The actuation member 84 straddles the end wall 66 of the outer body 10 with the second portion 84*c* slidably supported on the end wall 66 with the first portion 84*a* positioned between the end wall 66 and the inner wall 68 of the outer body 10. At one end, the latch pin 80 defines an upward facing latch surface 92.

As seen in FIGS. 4 and 5, the latch pin 80 extends through the holes 74*a* in the end wall 66 and the hole 84*c* in the actuation member 84 and its end 93 engages the wing portions of the actuation member 84.

Figure 4A:
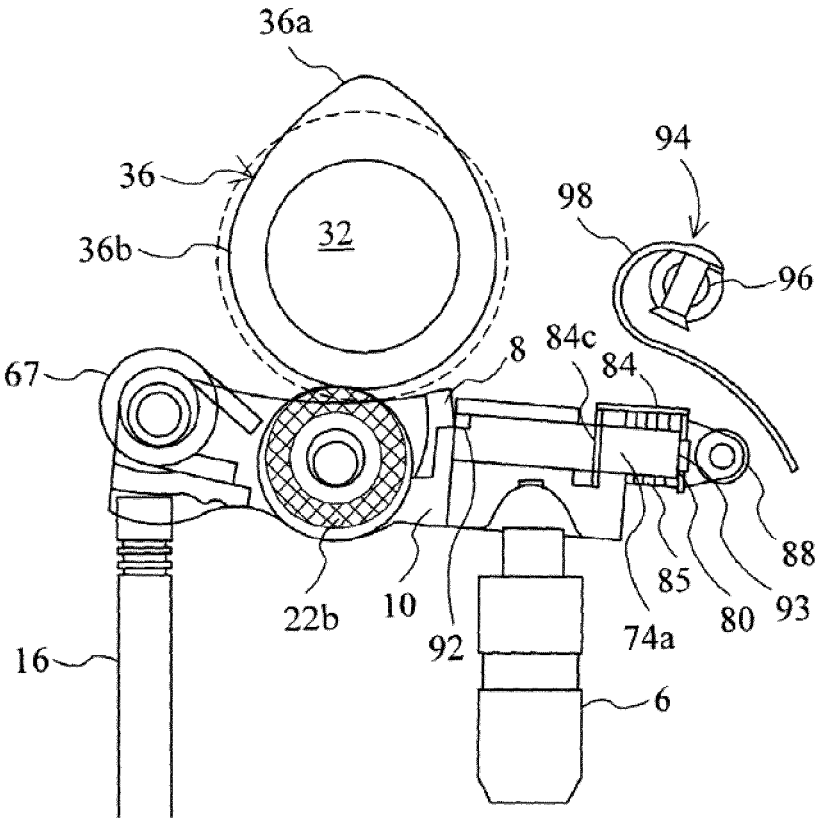
FIGS. 4*a* and 4*b* schematically illustrate a cross section of a valve train assembly at two different points in engine cycle when the inner and outer bodies are latched, according to an example.
Figure 4B:
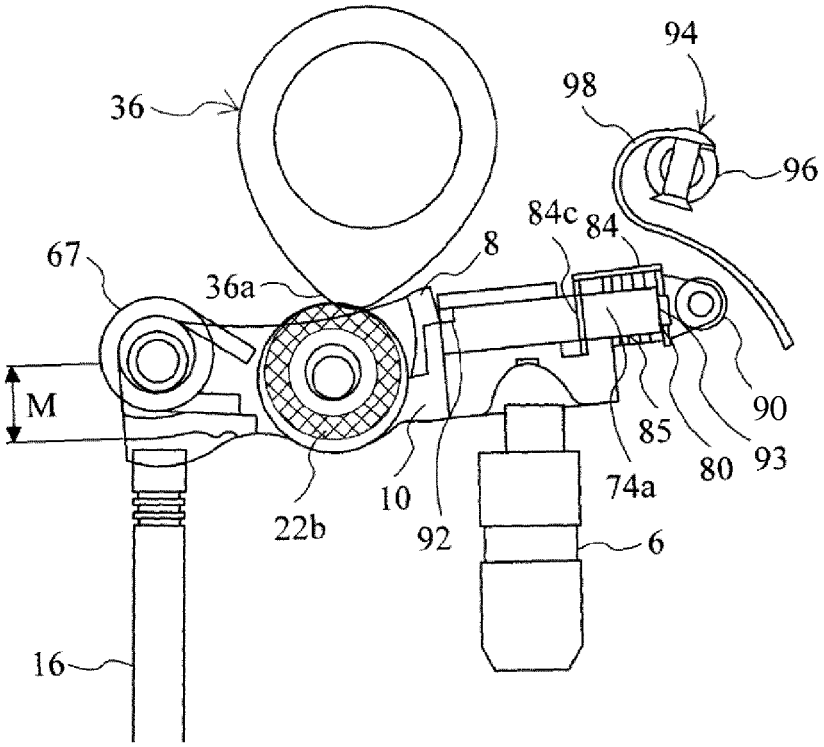

FIGS. 4*a* and 4*b* illustrate the valve train assembly 1 when the rocker arm 2 is in the single lift mode (i.e. unlatched configuration). In this configuration, the actuation member 84 and latch pin 80 are positioned so that the latch surface 92 does not extend through the hole 74*b* and so does not engage the latch contact surface 54 of the inner body 8. In this configuration, the inner body 8 is free to pivot, with respect to the outer body 10, about the shaft 12 when the secondary roller 26 engages the lift profile 38*a* and hence there is no additional valve event. It will be appreciated that the amount of movement available to the inner body 8 relative to the outer body 10 (i.e. the amount of lost motion absorbed by the inner body 8) is defined by the size difference between the diameter of the axle 24 and the inner diameter of the inner bushing/axle 43. The torsional spring 67, which is installed over the top of the valve stem 16 and is located inside the outer body 10 by the shaft 12, acts as a lost motion spring that returns the inner body 8 to its starting position with respect to the outer body 10 after it has pivoted.

Figure 5A:
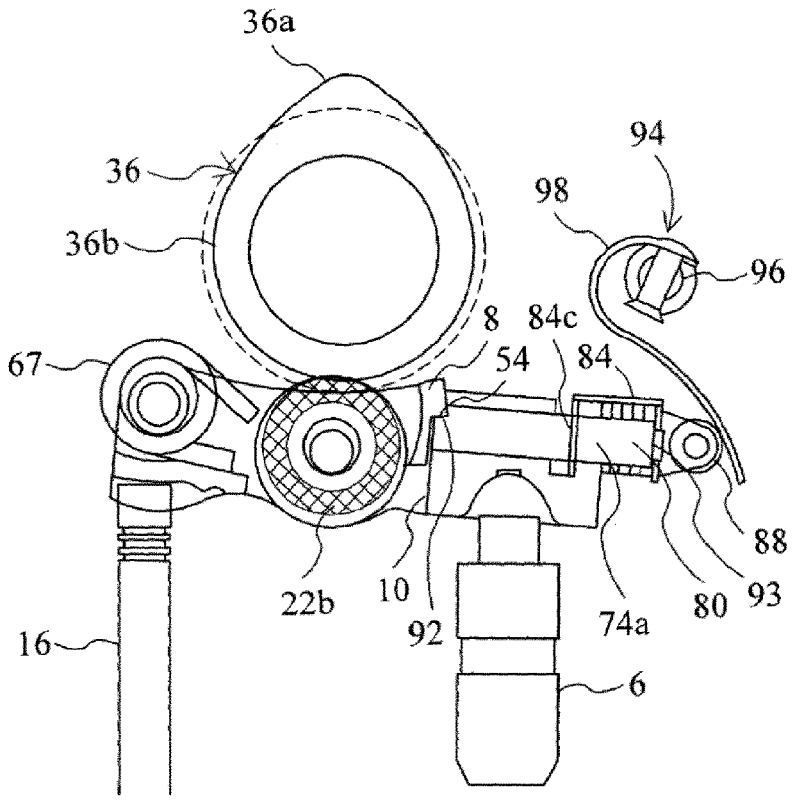
FIGS. 5*a* and 5*b* schematically illustrate a cross section of the valve train assembly at two different points in engine cycle when the inner and outer bodies are unlatched, according to an example.
Figure 5B:
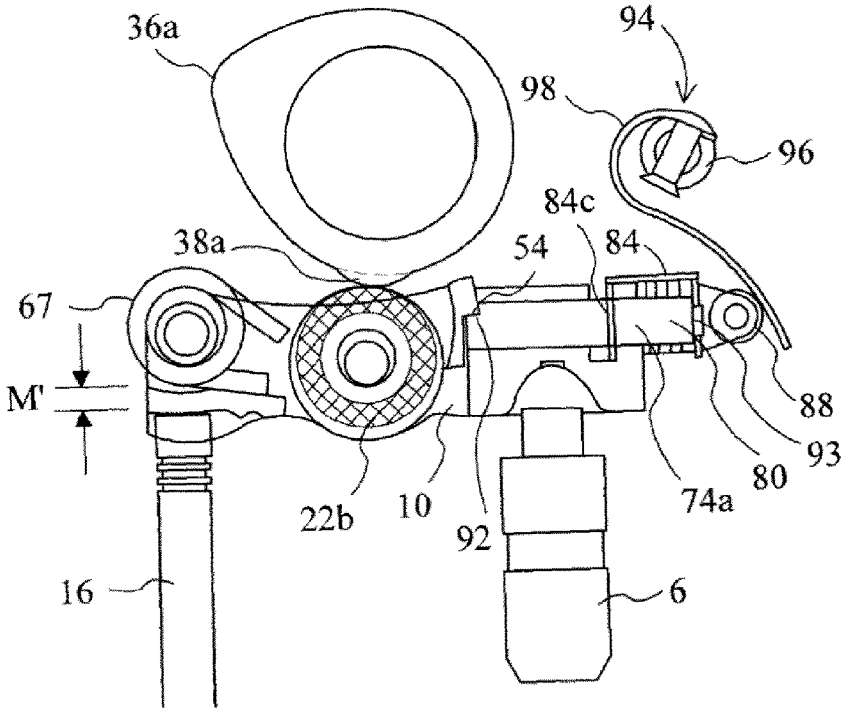

FIGS. 5*a* and 5*b* illustrate the valve train assembly 1 when the rocker arm 2 is in the dual lift mode (i.e. a latched configuration). In this configuration, the actuation member 84 and latch pin 80 are moved forward (i.e. to the left in the Figures) relative to their positions in the unlatched configuration so that the latch surface 92 does extend through the hole 74*b* so as to engage the latch contact surface 54 of the inner body 8. As explained above, in this configuration, the inner body 8 and the outer body 10 act as a solid body so that when the when the secondary roller 26 engages the lift profile 38*a* there is an additional valve event.

An actuator 94 is provided to move the latching arrangement 40 between the unlatched and latched positions. In this example, the actuator comprises an actuator shaft 96 carrying a biasing unit 98, which in this example comprises a flexible strip, preferably a leaf spring. In the default unlatched configuration, the leaf spring 98 does not engage the latching arrangement 40. To enter the latched configuration, the shaft 96 is rotated a certain amount (for example 12 degrees) causing the leaf spring 98 to engage the roller 88 and to push the latching arrangement 40 into the latched position. A spring 85 mounted over the latch pin 80 and supported between an outer face of the end wall 66 and the winged members of the member 84 is biased to cause the latching arrangement 40 to return to its unlatched position when the actuator shaft 96 is rotated back to its unlatched position and the leaf spring 98 disengages the roller 88.

Advantageously, when the base circle 38*b* engages the inner bushing/axle 43, the inner bushing axle 43 stops always on the axle 24 which ensures that the orientation of the various components is such that the latch pin 80 is free to move in and out of the latched and unlatched positions.

FIG. 4*a* illustrates the valve train assembly 1 when the rocker arm 2 is in the single lift mode (i.e. the un-latched configuration) at a point in an engine cycle when the main lift rollers 22*a* and 22*b* are engaging the respective base circles 34*b* and 36*b* of the first main lift cam 34 and the second main lift cam 36. At this point in the engine cycle, the valve 4 is closed. FIG. 4*b* illustrates the valve train assembly 1 when the rocker arm 2 is in the single lift mode at another point in an engine cycle when the main lift rollers 22*a* and 22*b* are engaging the respective peaks of the lift profiles 34*a* and 36*a* of the first main lift cam 34 and the second main lift cam 36. At this point in the engine cycle the valve 4 is fully open and the 'maximum lift' of the main valve event is indicated as M.

FIG. 5*a* illustrates the valve train assembly 1 when the rocker arm 2 is in the dual lift mode (i.e. the latched configuration) at a point in an engine cycle when the main lift rollers 22*a* and 22*b* are engaging the respective base circles 34*b* and 36*b* of the first main lift cam 34 and the secondary lift roller 26 is engaging the base circle 38*b* of the secondary lift cam 38. At this point in the engine cycle, the valve 4 is closed. FIG. 5*b* illustrates the valve train assembly 1 when the rocker arm 2 is in the single lift mode at another point in an engine cycle when the main lift rollers 22*a* and 22*b* are engaging the respective base circles 34*b* and 36*b* of the first main lift cam 34 and the second main lift cam 36 and the secondary lift roller 26 is engaging the peak of the lift profile 38*a* of the secondary lift cam 38. At this point in the engine cycle the valve 4 is fully open during the additional valve event and the 'maximum lift' of the secondary valve event is indicated as M'.

Figure 6:
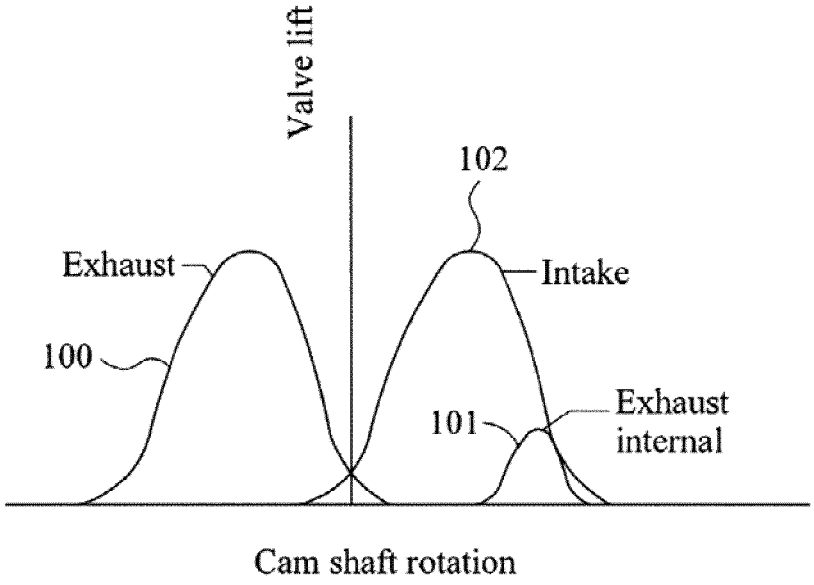
FIG. 6 illustrates a graph showing valve lift against cam shaft rotation.

FIG. 6 illustrates a graph in which the Y axis indicates valve lift and the X axis indicates rotation of the cam shaft. In the example of the valve 4 being an exhaust valve, the curve 100 represents the main lift of the exhaust valve during an engine cycle and the curve represents 101 the additional lift of the exhaust valve during the subsequent engine cycle. The curve 102 represents the lift of intake valve, during the subsequent engine cycle, operated by an intake rocker arm in response to an intake cam mounted on the cam shaft. It can be seen that the cams are arranged so that in any given engine cycle, the additional smaller opening of the exhaust valve occurs when the intake valve is open to thereby provide a degree of internal exhaust gas recirculation.

As previously mentioned, in an alternative arrangement the valve 4 is an intake valve rather than an exhaust valve (making the rocker arm 2 an intake rocker arm) and an exhaust rocker arm operates an exhaust valve in response to an exhaust cam mounted on the cam shaft. In this alternative arrangement the cams are arranged so that in any given engine cycle, the additional smaller opening of the intake valve occurs when the exhaust valve is open to thereby provide a degree of internal exhaust gas recirculation.

FIGS. 7 to 10 illustrate schematically a valve train assembly 1 comprising a switchable rocker arm 2, and an actuation system 3 according to another example. Like features are given like reference signs.

It is noted that the rocker arm 2 described with reference to FIGS. 7 to 10 differs from the rocker arm 2 described with reference to FIGS. 1 to 6 in that the latch pin 80 of the rocker arm 2 described with reference to FIGS. 7 to 10 is angled relative to the plane of the rocker arm 2, resulting in a rocker arm 2 with a slight V shape, whereas the latch pin 80 of the rocker arm 2 described with reference to FIGS. 1 to 6 is parallel to the plane of the rocker arm 2, resulting in a substantially straight shaped rocker arm. However, it will be appreciated that the operation of the 'V shaped' rocker arm 2 and the substantially straight shaped rocker arm 2 is in general the same, and that the operation of the substantially straight shaped rocker arm 2 described above with reference to FIGS. 1 to 6 may be applied equally to the operation of the 'V shaped' rocker arm 2 described with reference to FIGS. 7 to 10.

Moreover, although the example rocker arm 2 is referred to in the below, it will be appreciated, again, that the rocker arm 2 may be any rocker arm comprising a plurality of bodies that move relative to one another, and which are latched together to provide one mode of operation (valve-lift mode) and are unlatched, and hence can move with respect to each other, to provide a second mode of operation (valve-lift mode). For example, rocker arm 2 may configured for internal Exhaust Gas Recirculation (iEGR), Cylinder Deactivation (CDA), Early Exhaust Valve Opening (EEVO), or the like applications.

Figure 7:
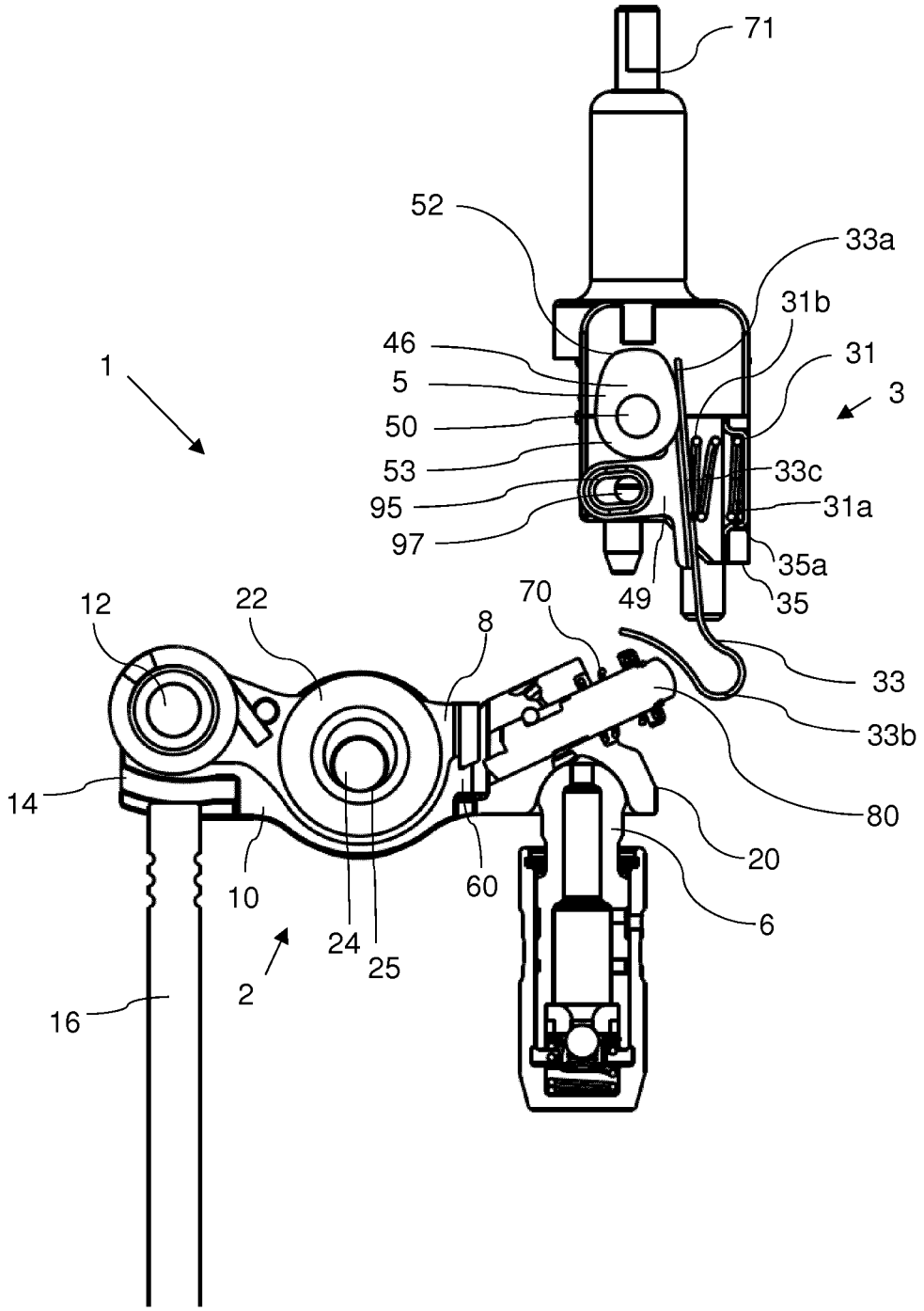
FIG. 7 illustrates a schematic cross section of a portion of a valve train assembly including a rocker arm and an example actuation transmission system; according to an example.

Referring now to FIG. 7, the rocker arm 2 is similar to the rocker arm 2 described above with reference to FIGS. 1 to 6, and comprises an inner body or arm 8 and an outer body or arm 10. The inner body 8 is pivotally mounted on a shaft 12 which serves to link the inner body 8 and outer body 10 together. A first end 14 of the outer body 10 engages a stem 16 of a valve and at a second end 20 the outer body 10 is mounted for pivotal movement on the lash adjustor 6 which is supported in an engine block. The lash adjuster 6, which may for example be a hydraulic lash adjuster (HLA), is used to accommodate slack between components in the valve train assembly 1.

Similarly to the rocker arm 2 as described above in more detail with reference to FIGS. 1 to 6, the rocker arm 2 is provided with a pair of main lift rollers (not visible in FIG. 7) mounted on an axle 24 carried by the outer body 10. One of the main lift rollers 22*b* is located one side of the outer body 10 and the other of the main lift rollers is located the other side of the outer body 10. The rocker arm 2 is further provided with a secondary lift roller 22 located within the inner body 8 and rotatably mounted on an axle 25 carried by the inner body 8.

Similarly to as described above in more detail with reference to FIGS. 1 to 6 the valve train assembly 1 is further provided with a three lobed camshaft (not shown in FIGS. 7 to 10) comprising a rotatable camshaft (not shown in FIGS. 1 to 10) comprising first and second main lift cams and a secondary lift cam located between the first and second main lift cams. The first and second main lift cams are each for engaging a respective one of the main lift rollers and the secondary lift cam is for engaging the secondary lift cam.

The rocker arm 2 is switchable between a two modes of operation. In a first lift mode, the inner body 8 and the outer body 10 are latched together by a latching arrangement (e.g. latch pin) 80 and hence act as a single solid body. In a second lift mode, the inner body 8 and the outer body 10 are not latched together, and so the inner arm 8 is free to pivot with respect to the outer arm 10 about the shaft 12. Examples of the different lift modes may be similar to as discussed above with reference to FIGS. 1 to 6.

The actuation transmission system 3 is for actuating a valve lift mode of the rocker arm 2, by transmitting an actuation force from an auxiliary cam 5 to the latch pin 80 of the rocker arm.

The auxiliary cam 5 comprises a rotatable camshaft 50 mounted on which is a lift cam 46. The lift cam 46 comprises a lift profile 52 and a base circle 53. As described below, the lift profile 52 of the lift cam 46 is for applying an actuation force to a lever 33 of the actuation system 3, for causing actuation of the latch pin 80 of the rocker arm 2. The rotatable camshaft 50 is drivable by a drive mechanism 71, which may be a motor, for example an electric motor or a hydraulic motor. When the drive mechanism 71 is controlled to rotate (for example when a lift mode of the rocker arm 2 is desired to be changed), the rotating drive mechanism 71 causes the camshaft 50 to rotate (via a gear), which in turn causes the lift cam 46 to rotate (for example clockwise in the sense of FIG. 7), so that the lift profile 52 applies an actuation force to the lever 33 of the actuation system 3.

The actuation system 3 comprises a housing 35*a* lever 33 (which is for example, a flexible biasing unit, for example, a leaf spring), and a spring 31 (also referred to as a compliance spring 31). The actuation system 3, in response to the rotating auxiliary cam 5, activates (e.g. moves) the latch pin 80 to latch the inner body 8 and the outer body 10 together and de-activates (e.g. moves) the latch pin 80 to un-latch the inner body 8 and the outer body 10.

The housing 35 may be, for example, located in or be part of an engine (block) of an overall internal combustion engine.

The lever 33 is an elongate member 33, for example a plate. A first end 33*a* of the lever 33 is for contacting with the auxiliary cam 5. A second end 33*b* of the lever 33 is for contacting the latch pin 80 of the rocker arm 2. The second end 33*b* of the lever 33 is curved so as to form a hook shape. The lever 33 thereby defines an arcuate surface for contacting with the latch pin 80. This may reduce friction between the latch pin 80 and the lever 33 when contacting the latch pin 80, and hence reduce wear thereof. The compliance spring 31 contacts the lever 33 on a first side of the lever 33, substantially mid-way along its length, i.e. substantially mid-way between the first end 33*a* and the second end 33*b* of the lever.

Figure 10:
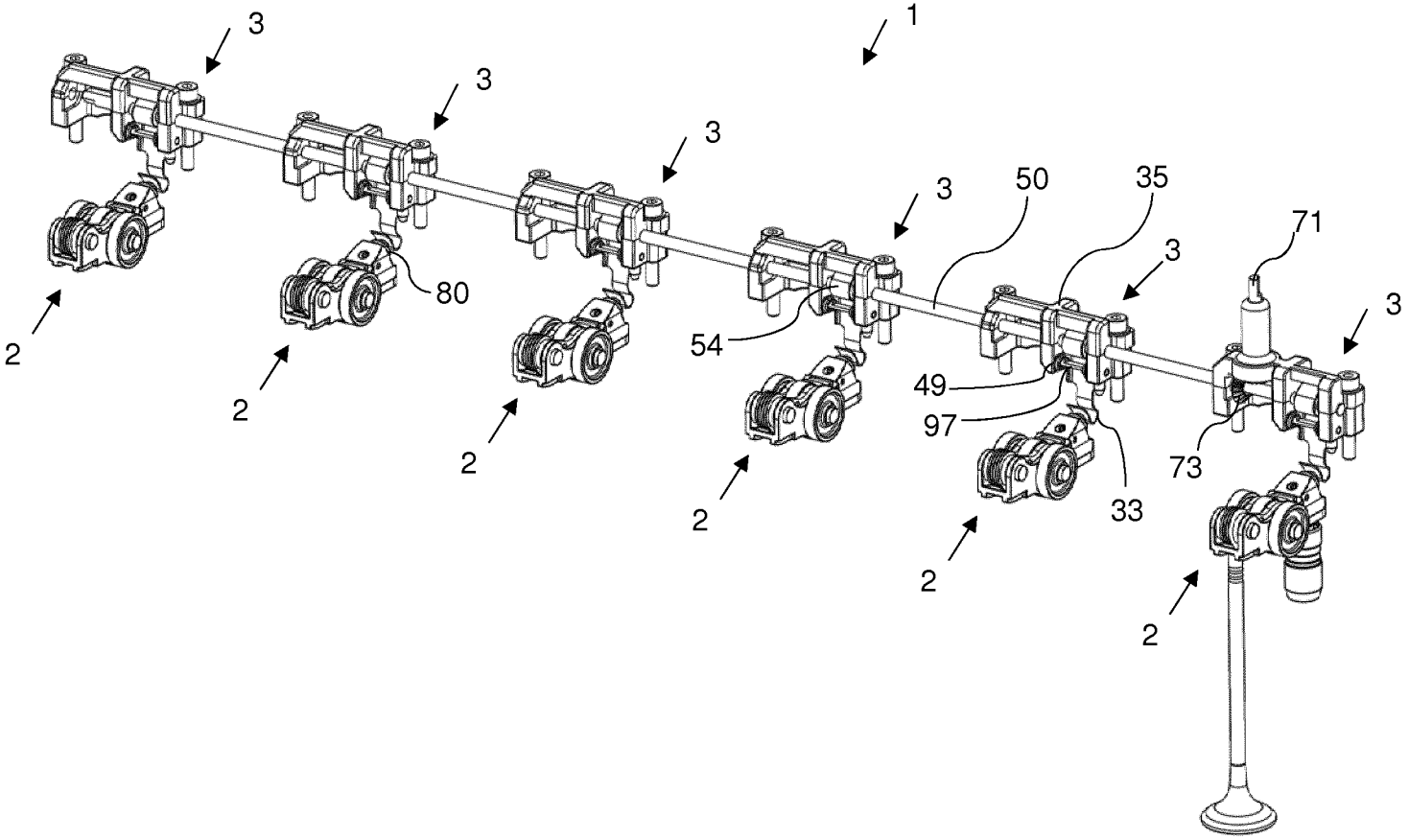
FIG. 10 schematically illustrates a perspective view of a valve train assembly comprising a plurality of rocker arms with a respective plurality of actuation transmission systems, according to an example.

The lever 33 has a protrusion 49 at a centre portion 33*c* mid-way along the length of the lever 33, i.e. is substantially mid-way between the first end 33*a* and the second end 33*b* of the lever. The protrusion 49 is on a second side of the lever 33, opposite to the side of the lever 33 that the compliance spring 31. The protrusion 49 extends perpendicularly from the lever 33. The protrusion 49 has an elongate aperture or slot 95 extending perpendicularly from the lever 33, i.e. perpendicularly away from a plane defined by the lever 33. A pin 97 fixed to the housing 35 is received in the slot 95 for sliding movement along the length of the slot 95. The lever 33 may therefore slide relative to pin 97, and hence relative to the housing 35, along the length of the slot 95. The pin 97 is substantially circular in cross section and defines an axis about which the lever 33 may rotate relative to the housing 35. In some examples, as is best seen in FIG. 10, the lever 33 may have two protrusions 49, each having an elongate slot 95 into which a common pin 97 fives relative to the housing 35 is received.

The compliance spring 31 is partially received in a recess 35*a* of the housing 35. A first end 31*a* of the compliance spring 31 contacts with a closed end of the housing recess 35*a*, and a second end 31*b* of the compliance spring 31 extends out beyond the open end of the housing recess 35*a*. The second end 31*b* of the compliance spring 31 contacts the centre portion 33*c* of the lever 33, to bias the lever 33 away from the recess 35*a* of the housing 35, and towards the pin 97.

In broad overview, when the auxiliary cam 5 attempts to actuate latch pin 80, via the lever 33 when the latch pin 80 is in an un-activatable state (see FIG. 9), the lever 33 compresses the compliance spring 31, and when the latch pin 80 becomes activatable again (see FIG. 8), the compliance spring 31 causes the lever 33 to activate the latch pin 80.

Figure 8:
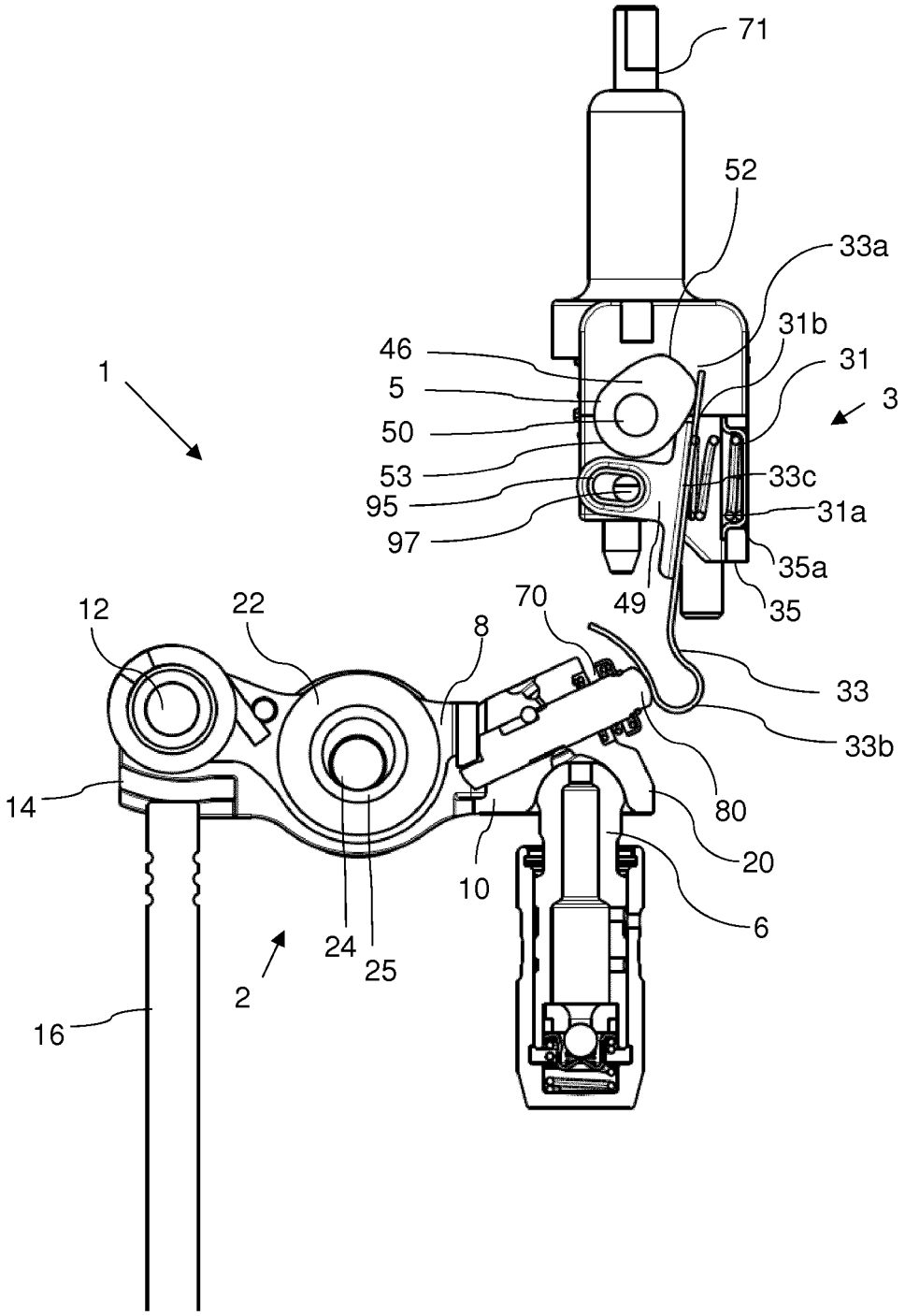
FIG. 8 schematically illustrates a cross section of an exemplary actuation transmission system at a time when the latch pin is free to move, according to an example.
Figure 9:
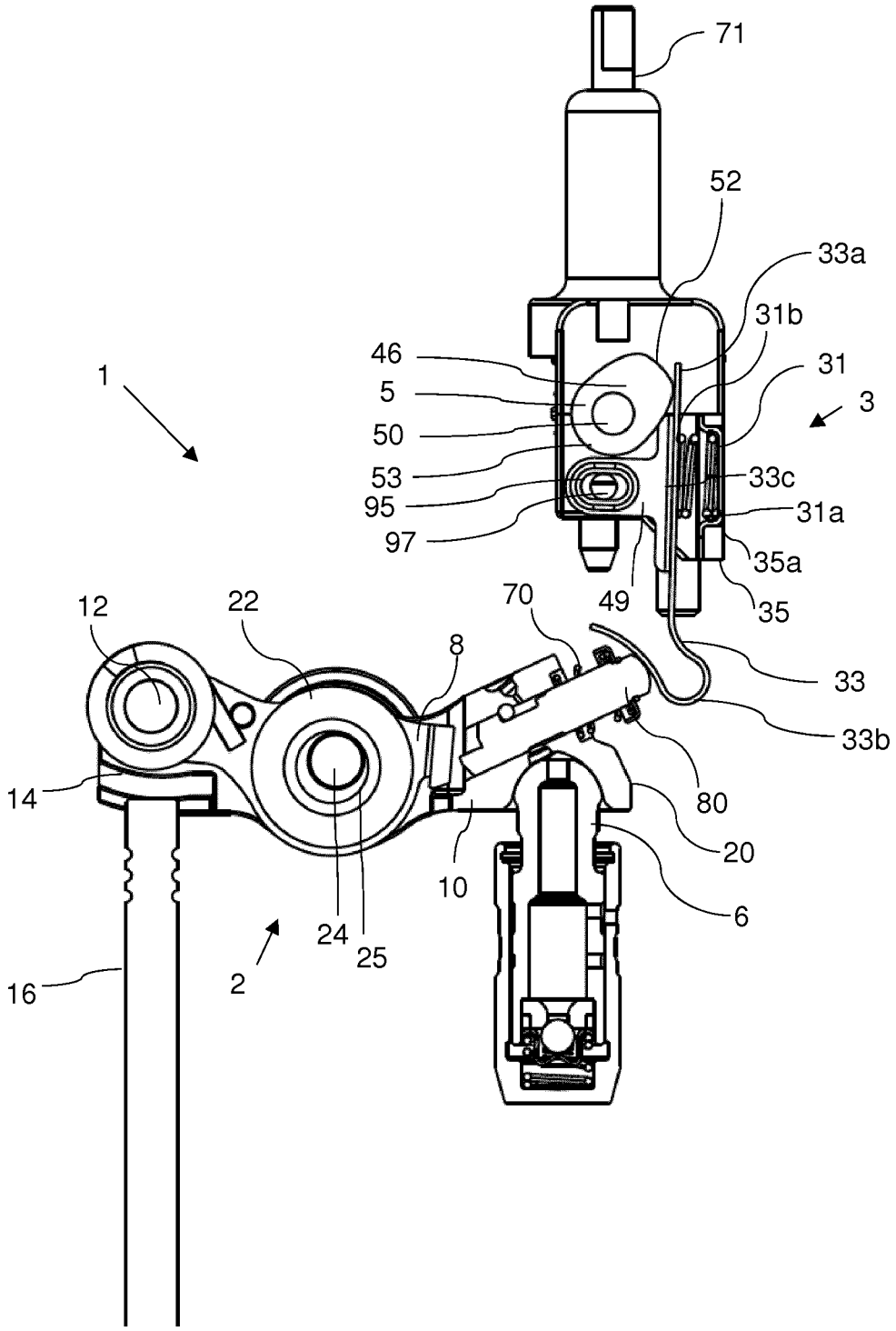
FIG. 9 schematically illustrates a cross section of an exemplary actuation transmission system at a time where the latch pin is blocked from moving, according to an example.

FIGS. 8 and 9 show the valve train assembly 1 of FIG. 7 at different times, e.g. at different points in the engine cycle. In FIG. 8, the rocker arm 2 is in an activatable state, whereas in FIG. 9 the rocker arm 2 is in an un-activatable state.

Referring first to FIG. 8, the compliance spring 31 pushes the lever 33 onto the pin 97. When the auxiliary cam 5 rotates (e.g. clockwise in the sense of FIG. 8) such that its lift profile 52 pushes against the first end 33*a* of the lever 33 the lever 33 pivots about the pin 97 (i.e. pivots about a point substantially central of the lever 33) such that the second end 33*b* of the lever 33 pushes against the latch pin 80 of the rocker arm 2. Since the latch pin 80 is free to move (i.e. the rocker arm 2 is in an activatable state), then the force of second end 33*b* of the lever 33 pushing against the latch pin 80 is sufficient to actuate the latch pin 80 immediately, hence latching the inner arm 8 and the outer arm 10 together. The rocker arm 2 may therefore be immediately actuated from, say, a second lift mode to a first lift mode as described above.

However, in some cases (such as illustrated in FIG. 9), the latch pin 80 may not be free to move (i.e. it may be blocked). For example, the actuation of the switchable component (e.g. latch pin 80) may not be possible immediately due to an engine condition. For example the actuation of the switchable component (e.g. latch pin 80) may not be possible immediately due to the inner arm 8 of the rocker arm 2 being pivoted down with respect to the outer body 10, and hence blocking the path of the latch pin 80 from moving into the latched position.

In the engine condition as illustrated in FIG. 9, the latch pin 80 is blocked from moving. In this example, this has occurred during an engine cycle where the lift profile of the lobed camshaft engages the lift roller 22 of the rocker arm 2 and hence the inner arm 8 is rotated with respect to the outer arm 10 about shaft 12, and hence the gap 60 into which the latch pin 80 would otherwise be free to extend is blocked by the inner arm 8 (see 9).

In this case where the latch pin 80 is not free to move (i.e. is blocked), then when the auxiliary cam 5 rotates (clockwise in the sense of FIG. 9) the force of the lift profile 52 of the auxiliary cam 5 pushing against the first end 33*a* of the lever 33 will cause the lever 33 to move towards the compliance spring 31 and away from the pin 97. Because the latch pin 80 is blocked, the force of the lift profile 52 pushing against the first end 33*a* of the lever 33 overcomes the biasing force of the compliance spring 31, and hence the lever 33 slides relative to the pin 97 in the slot 95 of the lever 33, i.e. a fulcrum point of the lever (i.e. a point about the lever 33 may rotate) moves. The force of the lift profile 52 of the auxiliary cam 5 pushing against the first end 33*a* of the lever 33 therefore causes the lever 33 to rotate about the latch pin 80, i.e. to rotate about the point at which the lever 33 contacts the latch pin 80, and causes the compliance spring 31 to compress. In other words, the compliance spring 31 absorbs an actuation force from the auxiliary cam 54.

As soon as (i.e. the instant that) the latch pin 80 becomes free to move again (i.e. becomes unblocked) (e.g. as in FIG. 8), the energy stored in the compression of the compliance spring 31 will cause (via lever 33) the latch pin 80 to actuate, hence latching the inner arm 8 and the outer arm 10 together (and hence allowing for the rocker arm to be actuated from, say, a second lift mode to a first lift mode as described above). More specifically, as soon as the latch pin 80 is free to move, the compressed compliance spring 31 pushing on the centre portion 33*c* of the lever 33 pushes the lever 33 away from the compliance spring 33 and towards the pin 97. The lever 33 slides relative to the pin 97 in the slot 95, and the lever 33 to rotates about the lift profile (or nose) 52 of the auxiliary cam 5, i.e. rotates about the point at which the lever 33 contacts the auxiliary cam 5. The second end 33*b* of the lever pushes the latch pin 80, hence latching the inner arm 8 and the outer arm 10 together. In other words as soon as an engine condition allows for the latch pin 80 to be activated/deactivated, the compliance spring 31 will expand again and transmit the actuation signal/energy to the latch pin 80. For example, the latch pin 80 may be free to be actuated as soon as an engine cycle occurs where the base circle of the lobed camshaft engages the lift roller 22 of the rocker arm 2 and hence the inner arm 8 is not rotated with respect to the outer arm 10 about shaft 12, and hence the gap 60 into which the latch pin 80 may move is free.

As a result, regardless of the blocked or unblocked state of the latch pin 80, the latch pin 80 may be actuated as soon as it is physically possible to do so, i.e. as soon as the rocker arm 2 is not in a state which blocks actuation of the latch pin 80. In other words, the actuation of the rocker arm 2 from, say, a second lift mode to a first lift mode as described above, is in effect delayed with respect to the actuation signal/force coming from the cam lift 46 of the auxiliary cam 5 to the earliest possible time that such actuation is physically possible.

At a later stage, when the base circle 53 of the auxiliary cam 5 again engages with the first end 33*a* of the lever 33, the second end 33*b* of the lever 33 ceases to apply a force to the latch pin 80, and hence the latch pin 80 may return to its default, unlatched state under force of a spring 70 that biases the latch pin 80 to its default, unlatched position.

The above solution allows easy packaging and installation of an actuation transmission system 3 on an engine. The solution allows for the actuation to happen as soon as possible, even if actuation of the switchable component might not be possible immediately due to the engine condition. The solution is space efficient.

FIG. 10 illustrates schematically a valve train assembly comprising a plurality, specifically six, rocker arms 2 as described above each with an actuation transmission system 3 as described above. The actuation transmission systems 3 share a common rotatable camshaft 50 that drives the auxiliary cams 54 of the respective actuation transmission systems 3. The common rotatable camshaft 50 is driven by a single drive mechanism 71 as described above, for example a motor, for example an electric or hydraulic motor. When a change in the valve-lift mode of the plurality of rocker arms 2 is required, the drive mechanism 71 is controlled to rotate, which in turn causes the rotatable camshaft 50 to rotate via a gear 73, which in turn causes the auxiliary cams 54 of the respective actuation transmission systems 3 to rotate, which in turn, as described above, causes the respective levers 33 to apply a force on the respective latch pins 80 of the rocker arms 2. As described above, depending on the engine condition for a particular one of the plurality of rocker arms 2, this force will either result in the immediate actuation of the latch pin 80 and hence change in the valve lift mode of the rocker arm 2, or will result in compression of the compliance spring 30 and hence actuation of the latch pin 80 and change in the valve lift mode of the rocker arm 2 at the next possible moment when the latch pin 80 is not blocked from moving and hence able to be actuated. The actuation transmission system 3 therefore allows the valve lift mode of a plurality of rocker arms 2 to be controlled by a single drive mechanism 71, without complicated control or synchronisation with the particular engine condition for a particular one of the plurality of rocker arms 2, and hence allows for a simple and efficient way to control valve lift modes of switchable rocker arms 2.

The above are to be understood as illustrative examples only. For example, an activation transmission system 3 may be used to activate and deactivate any suitable switchable engine or valve train component. Such a system may transmit a suitable activation signal/force form one point (i.e. an actuation source) of the system 3 to another. The actuation of the switchable component might not be possible immediately due to an engine condition. The transmission system may capture and store a suitable activation signal/force/energy and give it back to the switchable component as soon as the actuation can happen. Such a transmission system may provide that as soon as an engine condition allows for the switchable component to be activated/deactivated, the signal is transmitted to the switchable component. The storing of the signal/energy/force can be achieved by any suitable elastic element, e.g. any suitable biasing unit.

Although the rocker arm 2 described above with reference to FIGS. 7 to 10 has a slight V shape along its length, whereas the rocker arm 2 described above with reference to FIGS. 1 to 5*b* is substantially straight along its length, it will be appreciated that, as mentioned above, the operation of the V shaped rocker arm 2 and the substantially straight rocker arm 2 is in general the same, and hence that the actuation system 3 described above with reference to FIGS. 7 to 10 may apply equally to the rocker arm 2 as described above with reference to FIGS. 1 to 5*b*, and indeed may apply equally to any valve train components comprising a plurality of bodies that move relative to one another, and which are latched together to provide one mode of operation and are unlatched, and hence can move with respect to each other, to provide a second mode of operation.

It will be appreciated that although in the above examples the lever 33 has an elongate slot 95 in which a pin 97 fixed relative to the housing 35 is received and is slidable, this need not necessarily be the case, and other examples may use other sliding elements. In some examples, the slot 95 may be a substantially circular aperture 95. The lever 33 may comprise a pin 97, for example received in the circular aperture 95, or otherwise connected to the lever, which pin 97 is received in and slidable within a corresponding slot of the housing 35 or other element fixed relative to the housing 35, for example. In other examples, the lever may be moveable along some other sliding element, such as a rail or the like. It will therefore be appreciated that the actuation transmission system 3 may comprise any suitable sliding element 95,97 along which the lever 33 is arranged to slide, for example when the auxiliary cam 5 moves the lever 3 when the rocker arm 2 is in an un-activatable state, e.g. when the latch pin 80 is blocked, for example.

All of the above embodiments are to be understood as illustrative examples of the invention only. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. An actuation apparatus for actuating a switchable rocker arm of an internal combustion engine, the apparatus comprising:

a lever configured to contact an actuation source comprising a cam driven by a camshaft and to contact the switchable rocker arm; and a biasing unit comprising a compliance spring;

wherein the biasing unit contacts the lever, wherein the biasing unit is configured to become biased by the lever when the actuation source moves the lever when the actuation source attempts to actuate the switchable rocker arm, via the lever, when the switchable rocker arm is in an un-activatable state, whereby the biasing unit causes the lever to activate the switchable rocker arm when the switchable rocker arm is in an activatable state again, wherein the lever comprises an elongate member having a first end configured to contact the cam of the actuation source and a second, opposite, end configured to contact the switchable rocker arm, and wherein the actuation source is configured to move a fulcrum point of the lever when the actuation source moves the lever when the switchable rocker arm is in the un-activatable state.

2. The actuation apparatus according to claim 1, wherein the actuation apparatus comprises a sliding element along which the lever is arranged to slide, and wherein the actuation source is configured to move the lever along the sliding element when the actuation source moves the lever when the switchable rocker arm is in lthe un-activatable state.

3. The actuation source according to claim 2, wherein the biasing unit is configured to contact the elongate member on a first side of the elongate member, and the sliding element is located on a second, opposite side of the elongate member.

4. The actuation apparatus according to claim 1, wherein the lever rotates when the actuation source moves the lever when the actuation source attempts to actuate the switchable rocker arm, via the lever, when the switchable rocker arm is in the un-activatable state.

5. The actuation apparatus according to claim 4, wherein the lever rotates about a point for contacting the switchable rocker arm when the actuation source moves the lever when the actuation source attempts to actuate the switchable rocker arm, via the lever, when the switchable rocker arm is in the un-activatable state.

6. The actuation apparatus according to claim 1, wherein the lever rotates about a point for contacting the actuation source when the biasing unit causes the lever to activate the switchable rocker arm when the switchable rocker arm is in the activatable state again.

7. The actuation apparatus according to claim 1, wherein the lever is configured to activate the switchable rocker arm immediately when the actuation source attempts to actuate the switchable rocker arm, via the lever, when the switchable rocker arm is in the activatable state.

8. The actuation apparatus according to claim 1, wherein the lever rotates about a central portion of the lever when the actuation source attempts to actuate the switchable rocker arm, via the lever, when the switchable rocker arm is in the activatable state.

9. The actuation apparatus according to claim 1, wherein the biasing unit is configured to contact the elongate member substantially mid-way between the first end and the second end of the elongate member.

10. The actuation apparatus according to claim 1, wherein the elongate member defines an arcuate surface at the second end of the elongate member for contacting the switchable rocker arm.

11. A valve train assembly for an internal combustion engine, the valve train assembly comprising:

the actuation source comprising the cam driven by the camshaft;

the switchable rocker arm; and the actuation apparatus according to claim 1.

12. The valve train assembly according to claim 11, wherein the switchable rocker arm comprises a latch pin configured for actuation by the lever.

13. The valve train assembly according to claim 11, wherein the switchable rocker arm is configured for internal exhaust gas recirculation.

14. The valve train assembly according to claim 11, wherein the cam comprises a lift profile configured to apply a force to the lever to cause actuation of the switchable rocker arm.

15. The valve train assembly according to claim 11, further comprising a plurality of the switchable rocker arms and a corresponding respective plurality of the actuation apparatuses, wherein the actuation source is common to each of the plurality of actuation apparatuses.

16. The valve train assembly according to claim 15, wherein the actuation source comprises a plurality of cams driven by the camshaft, each one of the cams being configured to contact a respective lever of the respective plurality of actuation apparatuses.

17. The valve train assembly according to claim 16, wherein the camshaft is configured to be driven by an electric motor and/or a hydraulic motor.

18. An actuation apparatus for actuating a switchable rocker arm of an internal combustion engine, the apparatus comprising:

a lever configured to contact an actuation source comprising a cam driven by a camshaft and to contact the switchable rocker arm; and a biasing unit comprising a compliance spring;

wherein the biasing unit contacts the lever, wherein the biasing unit is configured to become biased by the lever when the actuation source moves the lever when the actuation source attempts to actuate the switchable rocker arm, via the lever, when the switchable rocker arm is in an un-activatable state, whereby the biasing unit causes the lever to activate the switchable rocker arm when the switchable rocker arm is in an activatable state again, wherein the actuation source is configured to move a fulcrum point of the lever when the actuation source moves the lever when the switchable rocker arm is in the un-activatable state, wherein the actuation apparatus comprises a sliding element along which the lever is arranged to slide, wherein the actuation source is configured to move the lever along the sliding element when the actuation source moves the lever when the switchable rocker arm is in the un-activatable state, wherein the actuation apparatus comprises a pin, and the lever comprises an elongate slot along which the pin is arranged to slide, and wherein the actuation source is configured to move the lever relative to the pin along the slot when the actuation source moves the lever when the switchable rocker arm is in the un-activatable state.

19. The actuation apparatus according to claim 18, wherein the lever comprises an elongate member having a first end configured to contact the actuation source and a second, opposite, end configured to contact the switchable rocker arm, and wherein the elongate slot extends substantially perpendicularly to a plane defined by the elongate member.

20. An actuation apparatus for actuating a switchable rocker arm of an internal combustion engine, the apparatus comprising:

a lever configured to contact an actuation source comprising a cam driven by a camshaft and to contact the switchable rocker arm; and a biasing unit comprising a compliance spring;

wherein the biasing unit contacts the lever, wherein the biasing unit is configured to become biased by the lever when the actuation source moves the lever when the actuation source attempts to actuate the switchable rocker arm, via the lever, when the switchable rocker arm is in an un-activatable state, whereby the biasing unit causes the lever to activate the switchable rocker arm when the switchable rocker arm is in an activatable state again, wherein the actuation source is configured to move a fulcrum point of the lever when the actuation source moves the lever when the switchable rocker arm is in the un-activatable state, wherein the actuation apparatus comprises a sliding element along which the lever is arranged to slide, wherein the actuation source is configured to move the lever along the sliding element when the actuation source moves the lever when the switchable rocker arm is in the un-activatable state, wherein the lever comprises an elongate member having a first end configured to contact the actuation source and a second, opposite, end configured to contact the switchable rocker arm, and wherein the biasing unit is configured to contact the elongate member on a first side of the elongate member, and the sliding element is located on a second, opposite side of the elongate member.

* * * * *